United States Patent [19]

Verkozen

[11] 4,149,465

[45] Apr. 17, 1979

[54] AMMUNITION CARTRIDGE

[76] Inventor: Jay M. Verkozen, 2521 Regent St., Berkeley, Calif. 94704

[21] Appl. No.: 654,385

[22] Filed: Feb. 2, 1976

Related U.S. Application Data

[63] Continuation of Ser. No. 389,473, Aug. 20, 1973, abandoned, which is a continuation of Ser. No. 173,750, Aug. 23, 1971, abandoned.

[51] Int. Cl.[2] ..... F42C 19/10

[52] U.S. Cl. ..... 102/45

[58] Field of Search ..... 102/38 R, 39, 45, 204

[56] References Cited

U.S. PATENT DOCUMENTS

| | | | |
|---|---|---|---|
| 2,759,419 | 8/1956 | Hitchens et al. | 102/39 |
| 3,340,809 | 9/1967 | Stadler et al. | 102/39 |

*Primary Examiner*—Verlin R. Pendegrass

*Attorney, Agent, or Firm*—Wills, Green & Mueth

[57] ABSTRACT

A cartridge is provided in which a tubular element extends axially of the cartridge from the primer through the powder charge in the cartridge. The tubular element can be made of a combustible material such as paper or plastic, or an explosive material or one which fragments readily.

1 Claim, 5 Drawing Figures

INVENTOR.
JAY M. VERKOZEN
BY

ATTORNEYS

AMMUNITION CARTRIDGE

This is a continuation of application Ser. No. 389,473 filed Aug. 20, 1973, which was a continuation of Ser. No. 173,750 filed Aug. 23, 1971, both applications now being abandoned.

BACKGROUND OF THE INVENTION

The present invention relates to an improved cartridge for use in small arms, e.g., rifles, shotguns, hand guns, or in cannons.

Frankfort Arsenal in 1868 proposed to attach a permanent metal flash tube to the cartridge case by threads in the flash hole to enable the flame from the primer to discharge into the powder charge well down the length of the casing. T. J. Rodman in 1860 proposed to mold the charge into a stack of several large washer shaped granules.

The cartridge construction of the present invention is more effective and less costly than either of the above constructions.

SUMMARY OF THE INVENTION

In accordance with the present invention, a tubular member extends axially of the cartridge from the primer through the powder charge. Thus, the shape of the body of the propellant is changed from an approximately cylindrical solid shape to one which has a passage extending through the cylinder which functions to increase burning progressiveness of the charge body by igniting the charge body along its pierced axis from which it then proceeds to burn radially outwardly. This construction also results in providing a more uniform ignition energy at all points along the axis of the body of the propellant charge, thereby contributing to the advantages achieved by piercing the powder charge.

This invention changes the shape of the initially ignited portion of the charge from a point to a thin cylinder along the center line of the powder charge. A metal flash extender tube merely moves the point of initiation of ignition of the powder from the head end of the case up to the center or to the neck of the case depending on the length of the tube. The change from point ignition to uniform ignition along the charge center line reduces the incidence of pressure shock waves inside the weapon which sometimes cause its destruction and injure persons near the weapon at the time of firing. Reference is "Pressure Excursions Explained", L. E. Brownell, *The Handloader Magazine,* No. 12, March–April 1968, page 18.

This invention also leads to efficient burning of the powder charge by igniting the powder so that the powder not directly ignited by the primer is located between the ignited powder and the cartridge case walls. When this invention is not used in ammunition, unignited powder is located between the bullet and the ignited powder which causes less complete combustion than when this invention is used.

This construction further includes the following advantages:

1. Increases the maximum velocity possible within allowable pressure limits when compared to other systems of ignition. Increasing the velocity increases power and flattens the trajectory, thereby increasing the effective range.

2. The improvement involves an insignificant cost to manufacture and assemble. The cost is far less than a metal flash tube and is insignificant compared to the unit cost of the assembled cartridge.

3. Higher effectiveness to cost ratio than other systems of ignition.

4. Compatible with all American center fire ammunition.

5. Reduces powder fouling due to better ignition. This increases the number of rounds which can be fired before the weapon must be cleaned.

6. Increases accuracy due to more uniform ignition and reduced powder fouling.

7. Reduces recoil for given velocity due to better powder utilization.

8. Reduces muzzle blast due to better ignition. Muzzle blast creates discomfort to the user, resulting in flinching and poor shooting.

9. Improves barrel accuracy life due to reduced abrasion of the barrel by unburned powder granules and due to lower chamber pressure.

10. Decreases heating of the barrel for a given velocity. This is very important in automatic weapons.

11. Insignificant weight increase in ammunition with greater effectiveness.

12. Prevents ball type powder from falling through flash hole which at present occasionally blows out primers and jams weapons.

13. Can be loaded into bottlenecked cases unlike a stack of large washer shaped powder granules which can only be loaded into cylindrical cases which are poor designs because they consume too much case metal for their powder capacity and because they require excessively long actions to load and unload the rounds.

14. No reinforcement or modification of cases is needed unlike permanent metal flash tube.

15. No danger of a flash tube becoming detached or deformed by explosion and damaging the weapon unlike permanent metal flash tube.

16. No disfunctional primer energy absorption unlike permanent metal flash tube.

17. Minimal loss of powder capacity unlike permanent metal flash tube.

18. Does not restrict gas flow from the chamber to the bore unlike permanent metal flash tube.

19. No critical materials needed for manufacture unlike permanent metal flash tube.

20. Simple to manufacture and assemble rapidly in large quantity with automatic machinery.

BRIEF DESCRIPTION OF THE PREFERRED EMBODIMENT

Figure 1:
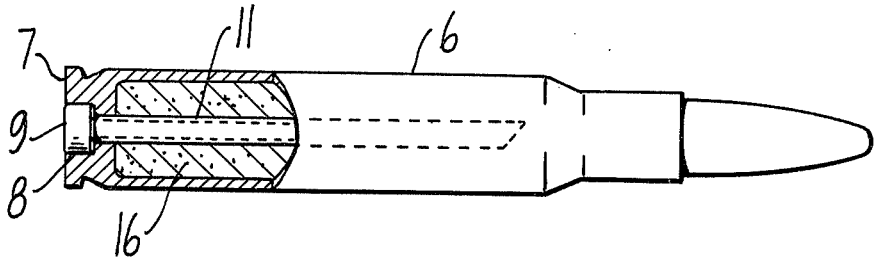
FIG. 1 is a side elevation partly in section showing a completed cartridge embodying this invention.

Referring to FIG. 1 particularly, the numeral 6 designates a cartridge case; this reference intended to be quite broad and to embrace a cartridge suitable for use in a rifle, shotgun, hand gun, or in a cannon. The cartridge includes a base 7 centrally apertured as at 8 to receive primer 9. In accordance with this invention, a combustible tubular member 11 extends from contact with the primer to the other end of the cartridge. This member is made of paper or other readily combustible material.

Figure 2:
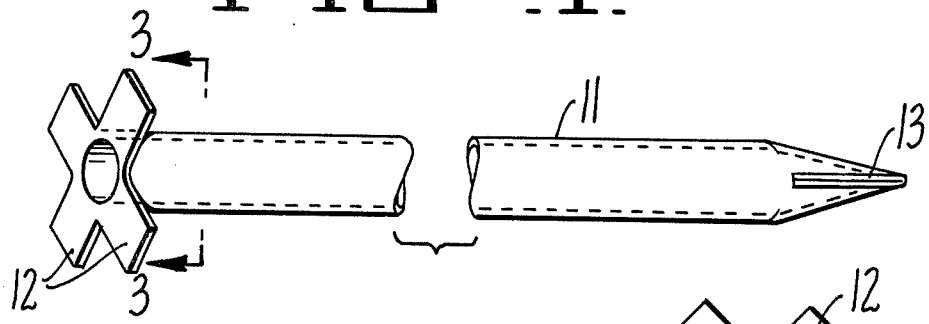
FIG. 2 is a side view with an end portion shown in perspective of the one form of the combustible member.
Figure 3:
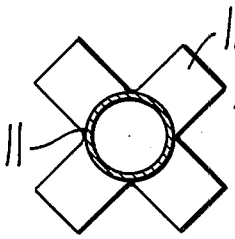
FIG. 3 is a section taken along the line 3—3.
Figure 4:
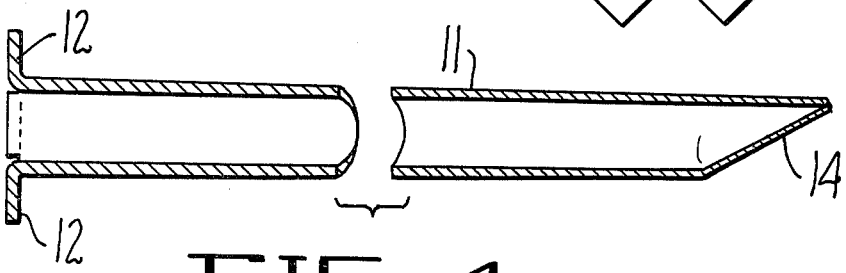
FIG. 4 is a section taken through a modified form of the combustible member.
Figure 5:
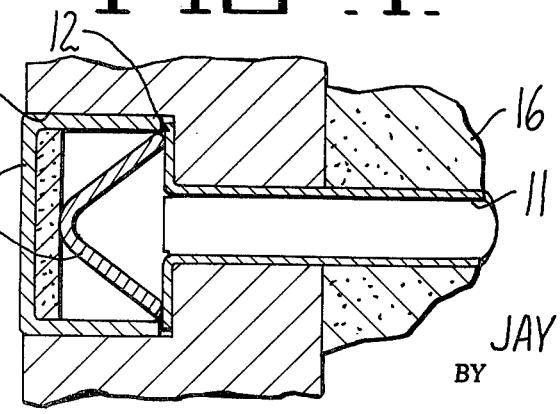
FIG. 5 is an enlarged fragmentary section of the base of the cartridge showing the relation between the primer and the combustible member.

To enable the tubular member to be installed and retained in place, it is provided with several extending ears 12 which fit between the base of the cartridge and the anvil 15 in primer 9 as is shown particularly in detail in FIG. 4. The end of the tubular member adjacent the other end of the cartridge is closed as by crimping, as is indicated at 13 in FIG. 2, or by having one side of the tubular member joined to the other as at 14 in FIG. 4 so that the powder 16 in the cartridge does not enter the tubular member.

In the preferred form of the tubular combustible member shown in FIG. 4, the side walls taper curvilinearly from the ears 12 to the opposite end so that the powder is ignited with uniform energy throughout the length of its pierced axis because of the tapered side walls.

From the foregoing, I believe that it will be apparent that I have provided a new and improved cartridge construction which provides the several advantage pointed out hereinbefore.

I claim:

1. An improved igniter for a centerfire cartridge having a base at one end with a central aperture therethrough, a primer disposed in said aperture and a propellant powder charge disposed in said cartridge, the improvement comprising an elongated tubular member having a first end open with provision for attachment at the base of said cartridge and a second end closed so as to separate the ignition system from the propellant powder, the open end of said tubular member being disposed generally axially of the base of said cartridge beyond the points of obduration of the primer in the cartridge, the closed end of said tubular member being disposed generally axially of the propellant powder charge inside the cartridge, said tubular member being formed of such combustible, explosible or fragmentable material that the combustion, explosion and fragmentation of said tubular member, primer and propellant powder charge deposit not more than slight fouling in the barrel of the firearm in which the cartridge is fired, said tubular member being of such configuration, exterior dimensions and flexibility as to permit it to be employed in a cartridge of the type which is the standard centerfire small arms cartridge in North America without deformation thereof.

* * * * *